US010549170B1

(12) United States Patent
Staggs et al.

(10) Patent No.: US 10,549,170 B1
(45) Date of Patent: Feb. 4, 2020

(54) GOLF SWING EXERCISE SYSTEM AND METHOD OF USE

(71) Applicants: Terry Staggs, Justiceburg, TX (US); Colt Staggs, Justiceburg, TX (US)

(72) Inventors: Terry Staggs, Justiceburg, TX (US); Colt Staggs, Justiceburg, TX (US)

( * ) Notice: Subject to any disclaimer, the term of this patent is extended or adjusted under 35 U.S.C. 154(b) by 0 days.

(21) Appl. No.: 15/647,959

(22) Filed: Jul. 12, 2017

Related U.S. Application Data

(60) Provisional application No. 62/361,068, filed on Jul. 12, 2016.

(51) Int. Cl.
*A63B 69/36* (2006.01)

(52) U.S. Cl.
CPC ..... *A63B 69/3644* (2013.01); *A63B 69/3632* (2013.01); *A63B 69/3623* (2013.01); *A63B 69/3641* (2013.01)

(58) Field of Classification Search
CPC ..... A63B 69/3641; A63B 2225/09; A63B 69/3644; A63B 2071/0694; A63B 2225/093; A63B 69/36; A63B 2053/023; A63B 60/22; A63B 21/4035; A63B 69/365; A63B 21/0615; A63B 21/08; A63B 21/4047; A63B 21/4049; A63B 2208/0204; A63B 69/0057
USPC ..... 473/221, 222, 225, 226, 257–261, 266
See application file for complete search history.

(56) References Cited

U.S. PATENT DOCUMENTS 1,465,056 A * 8/1923 Phelan ..... A63B 53/00 473/296
1,634,102 A * 6/1927 Hansen ..... A63B 69/3644 473/229
1,643,250 A * 9/1927 Longsworth ..... A63B 53/065 473/248
2,084,902 A * 6/1937 Eisenberg ..... A63B 69/3676 473/229
3,471,155 A * 10/1969 Donaldson ..... A63B 69/3676 473/260
3,794,329 A * 2/1974 Wilson ..... A63B 69/3644 473/229
4,365,807 A * 12/1982 Melby ..... A63B 60/22 473/295
5,413,339 A * 5/1995 Martin ..... A63B 53/14 473/295
5,692,969 A * 12/1997 Schooler ..... A63B 60/00 473/313
5,984,798 A * 11/1999 Gilmour ..... A63B 69/3644 473/221
6,419,601 B1 * 7/2002 Kenner ..... A63B 49/08 473/552
6,837,802 B1 * 1/2005 Santamaria ..... A63B 69/3676 473/229
7,367,896 B2 * 5/2008 Jackson ..... A63B 53/007 473/246

(Continued)

*Primary Examiner* — Nini F Legesse
(74) *Attorney, Agent, or Firm* — G. Michael Roebuck, PC

(57) ABSTRACT

A golf swing exercise machine allows a player to develop their golf swing by forcing the head of an adapted golf club to follow a preferred wing path. The path is marked by a rail. The rail is held by a rail support that is oriented with respect to the ground by a frame. The frame is made up of a base with side, front and back support members and horizontal supports. The golf club head has slots to allow the head to follow the rail.

18 Claims, 4 Drawing Sheets

(56) References Cited

U.S. PATENT DOCUMENTS

| | | | | |
|---|---|---|---|---|
| 7,670,233 | B2 * | 3/2010 | Jones | A63B 69/3641 473/226 |
| 7,806,780 | B1 * | 10/2010 | Plunkett | A63B 69/3641 473/229 |
| 8,715,098 | B2 * | 5/2014 | Napolitano | A63B 69/3644 473/257 |
| 9,089,756 | B1 * | 7/2015 | Kirschberg | A63B 69/3632 |
| 9,283,463 | B2 * | 3/2016 | Zimmerman, II | A63B 69/3644 |
| 2005/0075186 | A1 * | 4/2005 | Liao | A63B 69/3641 473/259 |
| 2010/0124998 | A1 * | 5/2010 | Bailey | A63B 69/3641 473/259 |
| 2014/0011602 | A1 * | 1/2014 | Zimmerman, II | A63B 69/3644 473/259 |
| 2016/0250531 | A1 * | 9/2016 | Chalifoux | A63B 53/14 473/299 |

* cited by examiner

GOLF SWING EXERCISE SYSTEM AND METHOD OF USE

BACKGROUND

1. Field of the Invention

The present invention relates generally the sport of golf, and more specifically, to a golf swing exercise machine and method of use.

2. Description of Related Art

The sport of playing golf is well known in the art and a popular competitive activity. FIG. 1 depicts an oblique view of a golfer 101 rotating his torso 105 while swing a golf club 103. It should be understood that conventional methods to practice golf include the physical exercise of playing golf and/or practice swinging the club 103 as depicted in FIG. 1.

A common disadvantage with conventional exercise routines is that a golf game does not provide the golfer with the necessary repetition necessary to perfect the swing and merely swinging the golf club also fails to teach the muscles the required swing path for a perfect swing. It is therefore desired to create a system and method to teach the required muscle groups to achieve a perfect golf swing. Although great strides have been made in the area of training golfers for a perfect swing, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
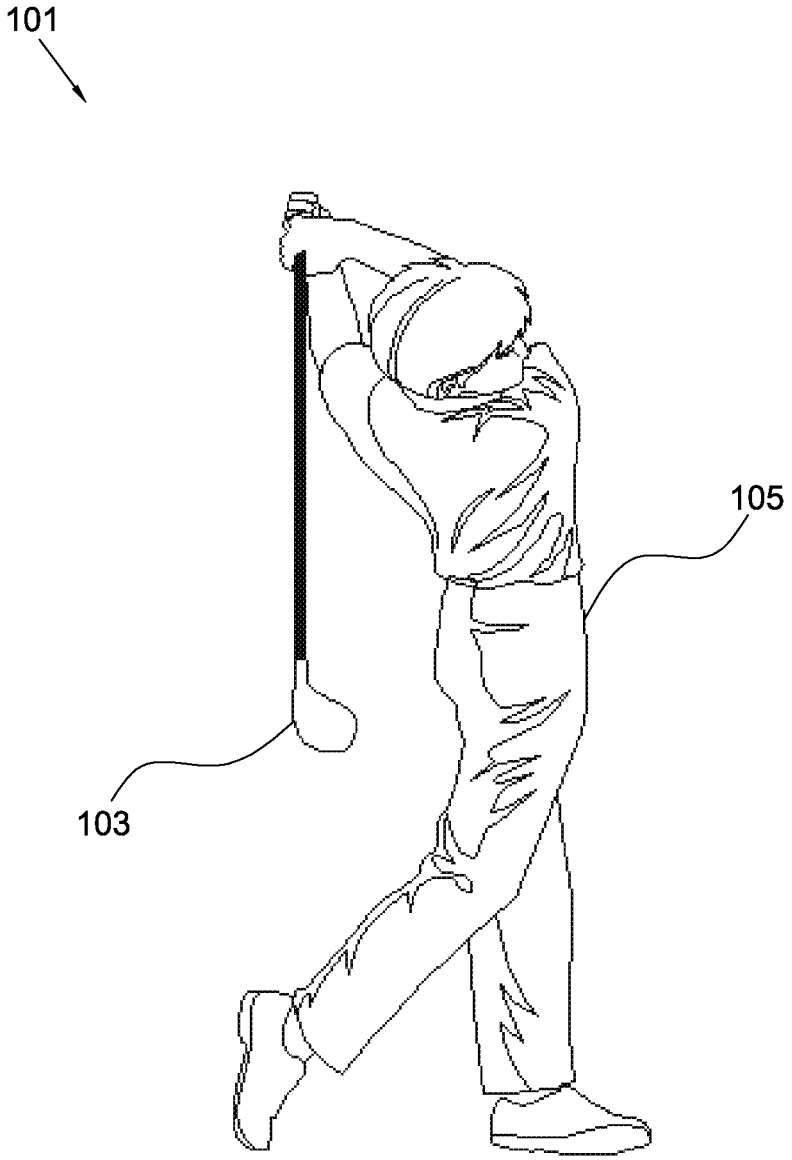
FIG. 1 (PRIOR ART)
FIG. 1 is a simplified oblique view of a conventional approach to swing a golf club.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 2-6 depict various views of the system and method of use in accordance with a preferred embodiment of the present application. It will be appreciated that system 201 overcomes one or more of the above-listed problems commonly associated with the conventional systems and method for golf swing exercise.

Figure 2:
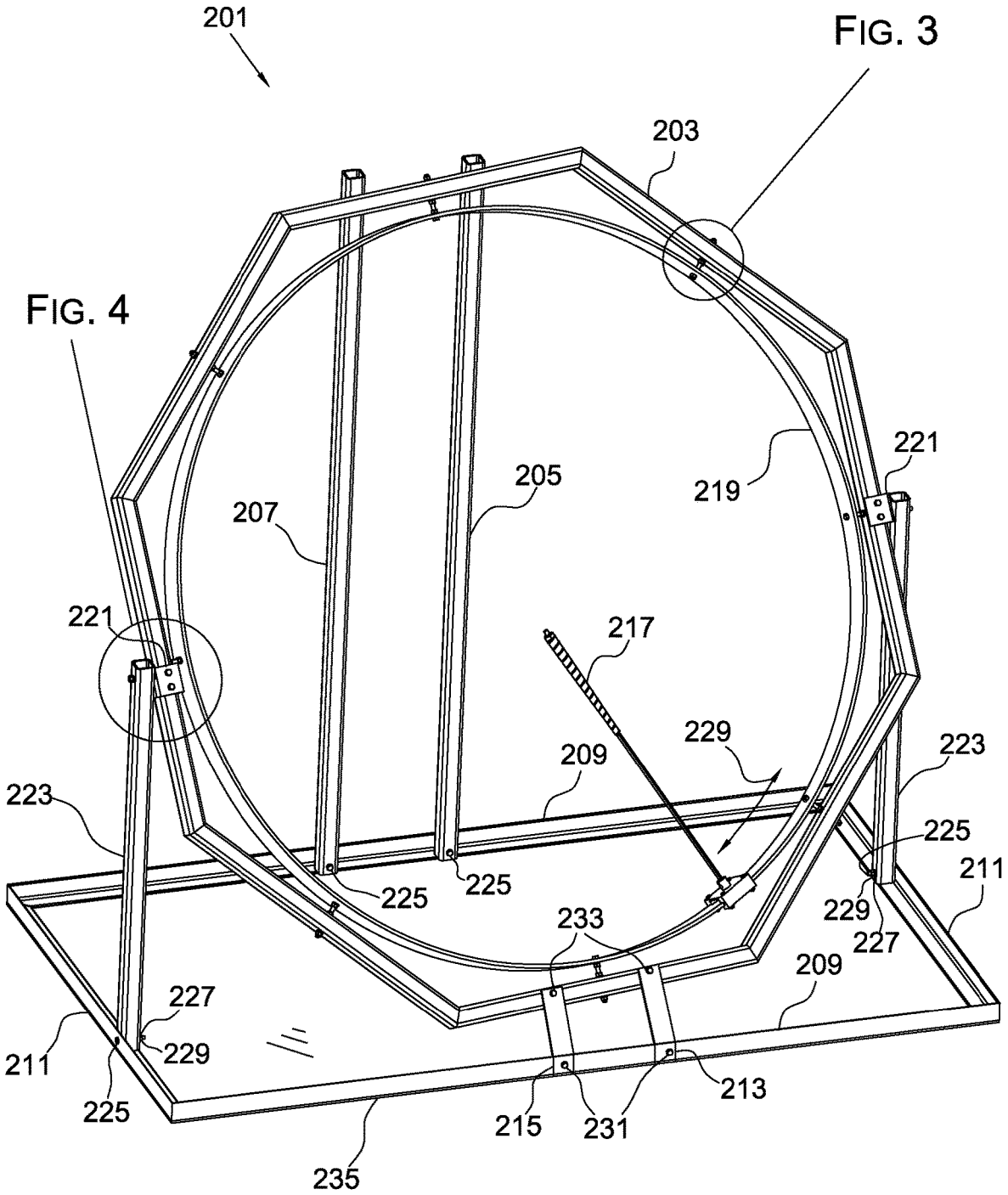
FIG. 2 is an oblique view of a golfing exercise machine in accordance with a preferred embodiment of the present application.

FIG. 2 depicts an oblique view of a golf swing exercise system 201 having a frame including a base having two side members 211 rigidly attached to a back support member 209 and a front support member 235. The base has four horizontal support members 205, 207, 223 and brackets 213 configured to engage with a rail support 203 at a desired orientation relative to the ground surface. A plurality of fasteners 225, 227, 229, and 231 are utilized to secure the supports and brackets to the base 211. Joints 221 are utilized to secure the rail support 203 at an angle relative to the ground surface. The angle of orientation is desired to provide the golfer with the optimal golf swing movement during use.

Figure 3:
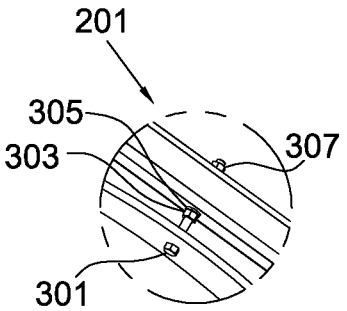
FIGS. 3 and 4 are partial views of the exercise machine of FIG. 2.
Figure 4:
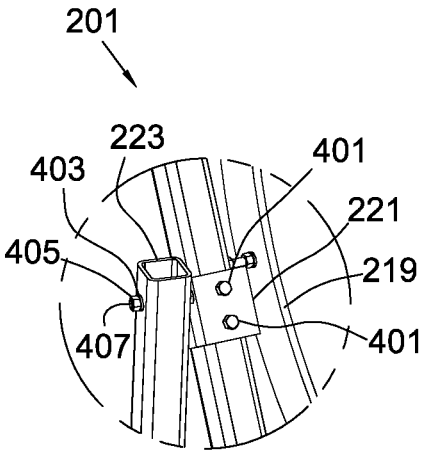

In FIG. 4, a detailed view of joint 221 is shown having nuts and bolts 401, 403, 405, and 407 configured to secure the rail support in a fixed position relative to the ground surface. In FIG. 3, a detailed view of an assembly is shown adapted to secure the rail to the rail structure. The assembly include an elongated rod 301 having bolts 303, 305, and 307 configured to secure the rail at a distance relative to the rail support.

The rail support 203 peripherally surrounds and secures to a circular elongated rail 219. The head 505 of a golf club 217 is adapted to slidingly engage with the elongated rail in the direction indicated by arrow 229.

Figure 5:
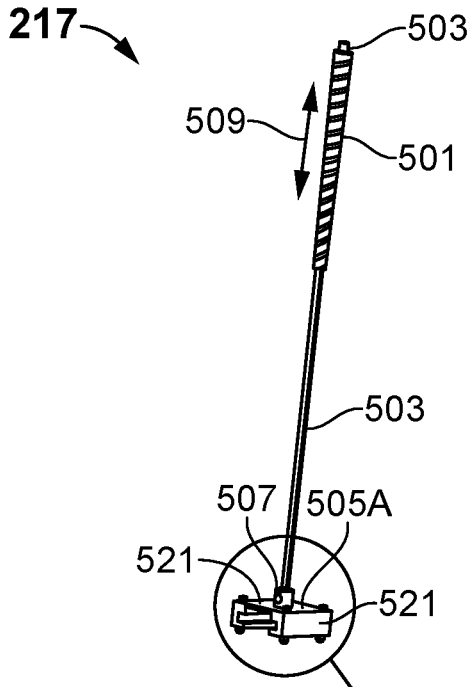
FIG. 5 is an oblique view of the golf club of the exercise machine of FIG. 2.
Figure 7:
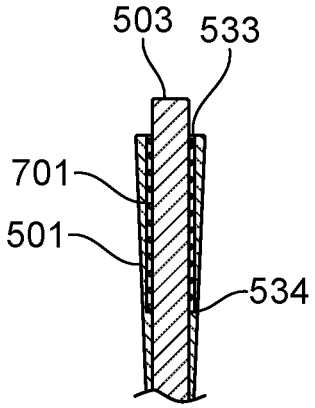
FIG. 7 is a partial cross-sectional view of the golf club of FIG. 5.
Figure 6:
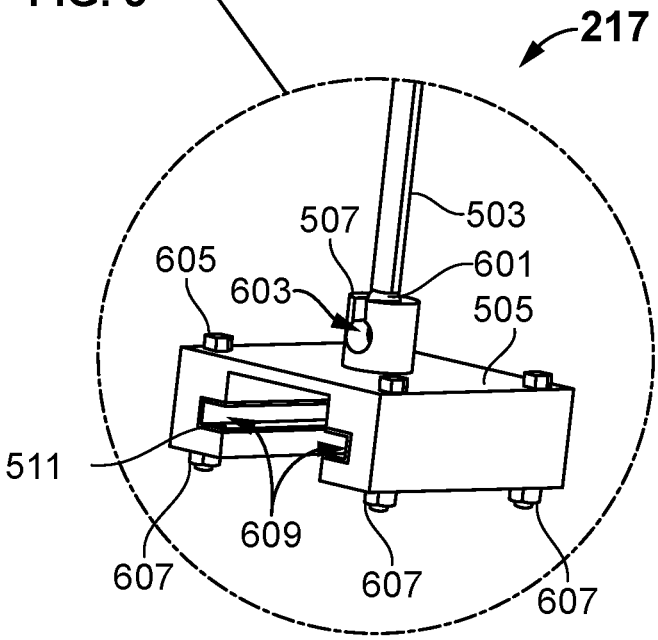
FIG. 6 is an exploded view of a portion of the golf club of FIG. 5.

In FIGS. 5-7 detailed features of the golf club 217 are shown. In the contemplated embodiment, the golf club 217 includes a gripping handle 501 adapted to slidingly engage with a shaft 503. As depicted in FIG. 7, a spring 701 is disposed between the handle 501 and the shaft 503. Accordingly, the spring 701 provides an opposing force as the shaft slides within the handle. The spring is attached to the top of the shaft at 534 and to the handle at 533.

The shaft 503 is pivotally attached to the head 505 via a housing 507 adapted to provide rotational movement of the head relative to the shaft 503. To achieve this feature, the housing 507 includes an inner cavity 603 adapted to receive a ball 601 section rigidly secured to the shaft 503. This feature provides rotational movement of the golf club during the swing as the head slides along the elongated rail. It will be appreciated that the opening of the housing also allows the golf club/shaft to move from a perpendicular angle relative to the rail at the start of the swing to past parallel at the top of the swing. In the contemplated embodiment, there is also a bolt extending through the plate of the housing to prevent the ball of the shaft from falling outside the housing cavity.

The golf club head 505 includes an opening forming two opposing slots 609 adapted to slidingly engage with the rail. In one embodiment, the slots could include elastomeric liners 511 removably attached to the slots. The liners could be removed for maintenance. In one contemplated embodiment, it is desired to have different weighted elastomeric liners 511 that provide adjustment of the weight disposed within the housing. Accordingly, the changes in weight further enhances the muscle exercised during the swing. A plurality of fasteners 605 and 607 could be utilized to secure the head and liners in a fixed position and later removed for maintenance.

During use, the user will move the golf club along the rail as indicated by arrow 229, which will train the user's muscles with the proper swing motion. The spring disposed between the handle and the shaft of the golf club will provide a distance relationship between the user and the rail during the swing motion. Also, the housing carried on the club head will allow rotational movement during the swing motion. The framing orients the rail at a desired rotational movement for optimal swinging motion. And, the changing of elastomeric liners provides effective means to change the weight of the shaft head, which in turn exercises the muscle groups during the swinging movement. In yet another embodiment, it is contemplated changing the weight of the head to have more or less weight. This feature could be achieved by having the upper and lower members of the head being removably attached and thereafter replacing the one or both members with a member 505A, 505B with greater or lesser weight. Accordingly, utilizing the system 201 discussed above provides effective means to train the user's muscles to achieve the optimal swing motion.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A golf swing exercise system comprising: a frame; and the frame comprising:

a base of a front support member and back support rigidly attached to the frame via a least one side member;

a plurality of horizontal supports attached to a rail support;

a circular flat rail attached to the rail support, wherein the circular flat rail forms a circular band having an exterior flat side surface and an interior flat side surface and a first edge and a second edge;

a golf club comprising a gripping handle slidably attached to a first end of a shaft, and a head attached to a second end of the shaft, wherein the head further comprises an opening formed in a center of a bottom surface of the head, wherein the opening has two opposing sides, wherein the two opposing sides each have a slot formed in the opening in the head, wherein a first edge of the circular flat rail fits into a first one of the two opposing slots and a second edge of the flat rail fits into a second one of the two opposing slots and wherein the circular rail slides within a first one of the two opposing slots, wherein the two opposing slots prevent the head from leaving the rail during full circular rotation in a plane formed by the rail of the golf club during a golf swing and wherein the shaft slides inside of the gripping handle during the golf swing, wherein the head and the two opposing slots slide along the rail as a player swings the golf club shaft by the gripping handle to train a player for a golf swing.

2. The system of claim 1, wherein a spring is disposed between the handle and the shaft wherein the spring provides an opposing force along the longitudinal axis of the shaft on the handle during the golf swing along a longitudinal axis of the shaft as the shaft slides within the handle, wherein the spring surrounds a top end of the shaft, wherein the shaft and spring fits inside of the handle, wherein a top end of the handle is cut off to allow the shaft to slide out of and extend through the top end of the handle at the top of the golf swing, as head slides along the circular rail and the distance between the head and handle decreases at a top of the golf swing.

3. The system of claim 1, the system further comprising:

at least one elastomeric liner fixed to an interior surface of the slots and between the interior surface of the slots and the circular rail.

4. The system of claim 3, wherein the elastomeric liner is a first elastomeric liner having a first weight and the elastomeric member is removable and so that the first elastomeric liner is removed and replaced by a second elastomeric liner having a second weight that is different than the first weight, thereby changing the weight of the club head.

5. The system of claim 1 wherein the head is a first head having a first weight and is removable and so that the first head is removed and replaced by a second head having a second weight that is different than the first weight, thereby changing the weight of the club head.

6. The system of claim 1, wherein the rail is rotationally connected to the frame by two joints, wherein the plane of the rail is rotated about the joints to adjust a plane of the golf swing.

7. A golf swing exercise system comprising:

a handle slidingly attached to a shaft, wherein the spring surrounds a top end of the shaft, wherein the shaft and spring fits inside of the handle, wherein a top end of the handle is cut off to allow the shaft to slide out of and extend through the top end of the handle at the top of the golf swing during the golf swing, as the head slides along the circular rail and the distance between the head and handle decreases at the top of the golf swing as the shaft slides in the handle;

a head including a cavity of a housing configured to accept a ball attached to the shaft; and the head having at least one slot configured to attach the golf club to a rail to slidingly engage the rail, wherein the spring provides an opposing force on the handle during the golf swing along a longitudinal axis of the shaft as the shaft slides within the handle during a golf swing.

8. The system of claim 7, the system further comprising:

wherein the handle slidingly engages the shaft and wherein a spring is disposed between the handle and the shaft wherein the spring provides an opposing force on the handle during the golf swing along a longitudinal axis of the shaft as the shaft slides within the handle during the golf swing.

9. The system of claim 7, the system further comprising:

at least one elastomeric liner fixed to an interior surface of the slot and between the interior surface of the slot and the rail.

10. The system of claim 9, wherein the elastomeric liner is a first elastomeric member having a first weight and the elastomeric member is removable and so that the first elastomeric liner is removed and replaced by a second elastomeric liner having a second weight that is different than the first weight, thereby changing the weight of the club head.

11. The system of claim 9, wherein the liner member is a first elastomeric liner having a first weight and wherein the liner member is removable and so that the first elastomeric liner is removed and replaced by a second elastomeric liner having a second weight that is different than the first weight, thereby changing the weight of the club head.

12. The system of claim 7 wherein the head is a first head having a first weight and is removable and so that the first head is removed and replaced by a second head having a second weight that is different than the first weight, thereby changing the weight of the club head.

13. The system of claim 7, the system further comprising:

at least one liner fixed to an interior surface of the slots and between the interior surface of the slots and the rail.

14. The system of claim 7 wherein the head is a first head having a first weight that is removable and so that the first head is removed and replaced by a second head having a second weight that is different than the first weight, thereby changing the weight of the club head.

15. The system of claim 7, wherein the rail is rotationally connected to a frame by two joints, wherein a plane of the rail is rotated about the joints to adjust the plane of the golf swing.

16. A golf swing exercise system comprising:

a rail;

a golf club comprising a gripping handle slidably attached to a shaft;

a head attached to the shaft, wherein the head includes an opening forming two opposing slots formed in the head, wherein the rail slidably fits within the two opposing slots, wherein the head and slots slide along the a circular rail in a plane formed by the circular rail as a player swings the golf club shaft by the gripping handle to train a player for a golf swing.

17. The system of claim 16, wherein the handle slidingly engages the shaft and wherein a spring is disposed between the handle and the shaft wherein the spring provides an opposing force on the handle during the golf swing along a longitudinal axis of the shaft as the shaft slides within the handle as the head slides along the rail, wherein the spring surrounds a top end of the shaft, wherein the shaft and spring fits inside of the handle, wherein a top end of the handle is cut off to allow the shaft to slide out of and extend through the top end of the handle at the top of the golf swing, as the head slides along the circular rail and the distance between the head and handle decreases at a top of the golf swing.

18. The system of claim 16, wherein the rail is rotationally connected to a frame by two joints, wherein the plane of the rail is rotated about the joints to adjust a plane of the golf swing.

* * * * *